United States Patent [19]

Tholance et al.

[11] Patent Number: 4,945,995

[45] Date of Patent: Aug. 7, 1990

[54] PROCESS AND DEVICE FOR HYDRAULICALLY AND SELECTIVELY CONTROLLING AT LEAST TWO TOOLS OR INSTRUMENTS OF A VALVE DEVICE ALLOWING IMPLEMENTATION OF THE METHOD OF USING SAID DEVICE

[75] Inventors: Michel Tholance, Feucherolles; Jacques Lessi, Maule; Jean-Paul Michel, Vaucresson, all of France

[73] Assignee: Institut Francais du Petrole, Rueil Malmaison, France

[21] Appl. No.: 302,666

[22] Filed: Jan. 27, 1989

[30] Foreign Application Priority Data

Jan. 29, 1988 [FR] France ..... 88 01087
Jan. 29, 1988 [FR] France ..... 88 01088

[51] Int. Cl.[5] ..... E21B 34/10; E21B 43/12; F16K 3/26; F16K 31/163

[52] U.S. Cl. ..... 166/375; 166/66.4; 166/321; 166/65.1; 166/381

[58] Field of Search ..... 166/66.4, 66.5, 65.1, 166/319, 381, 320, 321, 269, 375, 374, 332, 187; 137/882, 492.5, 505

[56] References Cited

U.S. PATENT DOCUMENTS 2,770,308 11/1956 Saurenman ..... 166/66.4
3,092,135 6/1963 Brown et al. ..... 166/321 X
3,319,717 5/1967 Chenoweth ..... 166/320 X
3,371,717 3/1968 Chenoweth ..... 166/320 X
4,330,039 5/1982 Vann et al. ..... 166/323 X
4,574,894 3/1986 Jadwin ..... 166/319 X
4,660,647 4/1987 Richart ..... 166/72 X
4,771,831 9/1988 Pringle et al. ..... 166/321 X
4,796,699 1/1989 Upchurch ..... 166/66.4 X

*Primary Examiner*—Stephen J. Novosad
*Attorney, Agent, or Firm*—Antonelli, Terry, Stout & Kraus

[57] ABSTRACT

A process and device for hydraulically and selectively controlling, in two circulation directions, at least two tools or instruments connected to a casing located inside a well. A first hydraulic line is provided which includes branches to a first and a second of the two tools or instruments, with a distribution arrangement being adapted to modify a circulation of fluid in each of the branches and to enable an independent control, and with a hydraulic power generator being connected to the first hydraulic line. To selectively activate the first tool or instrument, the distribution arrangement of the second tool or instrument are shut off in order to reduce fluid circulation in the branch of the second tool or instrument, the distribution arrangement of the first tool or instrument are opened in order to increase fluid circulation of the branch of the first tool or instrument, and pressure is applied in the first hydraulic line in order to create a flow of fluid in the first direction in the branch of the first tool or instrument.

22 Claims, 2 Drawing Sheets

29
28
27
26
25
24
22
23
20
19
4
3
2
22
6
6a
14
13
7a
7
30
21a
35
21
16
15
8a
8
39
31
17
18
9a
9
32
36
40
12
33
10
41
37
11
12a
40
1

PROCESS AND DEVICE FOR HYDRAULICALLY AND SELECTIVELY CONTROLLING AT LEAST TWO TOOLS OR INSTRUMENTS OF A VALVE DEVICE ALLOWING IMPLEMENTATION OF THE METHOD OF USING SAID DEVICE

BACKGROUND OF THE INVENTION

The present invention relates to a method and a device for hydraulically and selectively controlling a set of instruments or tools connected to a casing located inside a well drilled in the ground, particularly a horizontal well.

The invention also provides a valve allowing the method to be implemented, said valve being able to use the device according to the invention.

In particular, the invention is applied to exploitation in stages of geological formations or producing zones such as oil-bearing or gas-bearing producing zones. For this usage, the tools that may be used may be valves disposed in each of the formations or each of the producing zones and remote-controlled using the method or device according to the invention.

One noteworthy advantage of the invention is the reduction in the number of hydraulic lines that had to be used according to the teaching of the prior art. This advantage is particularly perceptible at the points where the hydraulic lines pass through seals (where these are present), these seals being for example of the packer type; from the standpoint of the space occupied by the lines along the casing, particularly at its periphery; for reducing the cost of the hydraulic lines and positioning them as allowed by the invention.

The invention applies in particular to production by horizontal wells. particularly in oil drilling, production by a well causes displacement of the various layers of liquids in the producing zone, a phenomenon called coning. In production in horizontal wells, undesirable fluids such as water generally arrive irregularly along the well so that a large portion of the liquid sought, such as oil, is not extracted from the formations.

There are two approaches to overcoming this drawback; several producing zones are created and equipped with means such as valves that allow the flowrate to be controlled; and the quality and quantity of the fluids coming from each of the producing zones are controlled. This control may be effected by instruments such as flowmeters and physical and/or chemical instruments for measuring fluids, disposed for example along the well or casing according to each of the producing zones.

The invention furnishes a device for hydraulically and selectively controlling a set of at least two instruments or tools connected to a casing located inside a well, the well having at least two different producing zones, said two instruments or tools being disposed according to eahc of said producing zones. This device is characterized in particular by having a first hydraulic line with branches to the instruments or tools and having distribution means such as a solenoid valve places on each of the branches and controlled independently of each other by a distribution means control element, the first hydraulic line being connected to a hydraulic power generator.

The distribution means control element may include an electrical line.

The electrical line may be connected to a first electrical connector located inside the casing and designed to cooperate with a second matching electrical connector connected to the surface of the ground by a transmission cable.

The two producing zones may be separated from each other in the well by a sealing element such as an annular seal.

The first hydraulic line may be connected to the surface of the ground by the outside of the casing.

The first hydraulic line may be connected to a first hydraulic connector located inside the casing and designed to cooperate with a second matching hydraulic element connected to the surface of the ground by a pipe.

The device may include a second hydraulic line which has at least one branch supplying one of said instruments or tools.

At least one of said tools or instruments may include a reservoir designed to contain a variable quantity of hydraulic fluid, the reservoir being connected by a branch to the first hydraulic line.

The first hydraulic line or the second hydraulic line may be connected to said casing by a hydraulic connection including at least one shutoff element. The shutoff element may be retractable. The first or second line may serve as a pipe for creating fluid circulation in the casing.

The invention also supplies a process for hydraulically and selectively controlling, in two circulation directions, at least two tools or instruments of a device connected to a casing located inside a well, the device also having a first hydraulic line with branches to a first and a second of the two tools or instruments, distribution means designed to modify the circulation of fluid in each of the branches and controlled independently of each other, and a hydraulic power generator connected to said first hydraulic line. In accordance with the process of the present invention, in order to selectively activate the first tool or instrument, the distribution means of the second tool or instrument are shut off in order to reduce fluid circulation in the branch of the second tool or instrument, the distribution means of the first tool or instrument are opened in order to increase fluid circulation in a branch of the first tool or instrument, and pressure is applied in the first hydraulic line in order to create a flow of fluid in the first direction in the branch of the first tool or instrument.

The first tool or instrument may permit circulation of hydraulic fluid in the two opposite directions and may include a reservoir designed to contain a variable mass of fluid, said reservoir being connected by the first of said branches to the first hydraulic line, and in order to produce, in the branch of the first tool or instrument, a flow in a second direction opposite the first direction, the distribution means of the first tool or instrument may be opened and the pressure in the first hydraulic line may be reduced.

In addition, a second hydraulic line may be used, which has at least one branch to at least one of the tools or instruments, and in order to produce, in the branch with the first hydraulic line of the tool or instrument connected to the second hydraulic line, fluid circulation in a first direction or in a second direction opposite the first, the distribution means of the tool or instrument connected to the two lines may be opened, and in the first or second line, pressures may be created to produce fluid circulation in the branch to the first line, in the first or second direction.

The second tool or instrument may permit hydraulic fluid circulation in the two opposite directions and may include a reservoir designed to contain a variable mass of fluid. Since this reservior is connected by the second of the branches to the hydraulic line, and return means enable the second tool or instrument to revert to an initial position, to selectively activate the second tool or instrument, the distribution means of the first tool or insturment can be closed in order to prevent circulation of fluid in the branch of the first tool or insturment. The distribution means of the second tool or instrument may be opened to permit fluid circulation in the branch of the second tool or instrument, the first hydraulic line may be pressurized in order to create, in the branch of the second tool or instrument, a flow of fluid in the first direction, and, in order to produce a flow in the second direction opposite the first direction in the branch of the second tool or instrument, the pressure in the first hydraulic line may be reduced. Once fluid circulation has been produced, in the first or second tool or instrument, in the first or second direction, the distribution means of the first or second tool or instrument may be shut off in order to prevent fluid circulation in the branch of the first or second tool or instrument.

When the method according to the invention is applied to selective production of a deposit, the first and second tool or instrument may be located on the casing and may be designed to modify the rate of production fluid transfer between the inside and the outside of the casing.

The distribution means may be controlled electrically by a cable connected to a first electrical connector located inside the casing, a second matching electrical connector may be introduced into and moved in the casing, which connector is connected to the surface of the ground by a transmission cable, and the first and second electrical connectors may be caused to cooperate in order to control the distribution means from the surface of the ground.

The hydraulic power generator may be disposed in the well in the vicinity of the tools or instruments.

The hydraulic line may be connected to a first hydraulic connector located inside the casing, a second matching hydraulic connector may be introduceds into and moved in the casing, which matching connector is connected to the surface of the ground by a pipe, the first and second hydraulic connectors may be caused to cooperate, and the hydraulic power generator may be located at the end of the pipe near the surface of the ground.

A pipe connected to said casing by a hydraulic connection may be located in the well, an element designed to shut off this connection may be disposed thereon, the pipe may be connected to the hydraulic generator, and the pipe may be used as the first or second hydraulic line.

The invention also provides a sliding jacketed valve usable for equipping casings of wells drilled into the ground.

The valve in particular allows, in a simple manner, selective production from geological formation traversed by the casing with the aid of a very small number of control lines. This reduction in the number of lines is particularly advantageous at the point where the lines pass through—these seals may be of the packer type—from the standpoint of the space occupied by the lines along the casing, particularly at its periphery and also reduction in the costs of installing these lines.

The sliding jacketed valve for production from wells drilled into the ground has an external cylindrical body designed to fit into a casing, an extension inside this body, a sliding jacket between the body and the extension, and allowing opening of the orifices that provide a connection between the inside and the outside of the valve, a thrust chamber delimited by the body, the extension, and one end of the jacket, the chamber being connected to hydraulic control means such as a line connected to a hydraulic generator.

This valve is in particular characterized by also having return means such as a spring acting on the jacket, whereby the hydraulic control means tend to move the jacket from an initial position against the action of the return means such as to change the apertures of the orifices, said return means being designed to return the jacket to the initial position in the absence of sufficient action on the part of the hydraulic control means.

The valve may comprise a safety jacket controlled mechanically by the inside of the casing and designed to change the apertures of the orifices.

The invention will be thoroughly understood and all its advantages will appear clearly from a reading of the description hereinbelow of which one embodiment is illustrated by the attached figures wherein:

DETAILED DESCRIPTION

Figure 1:
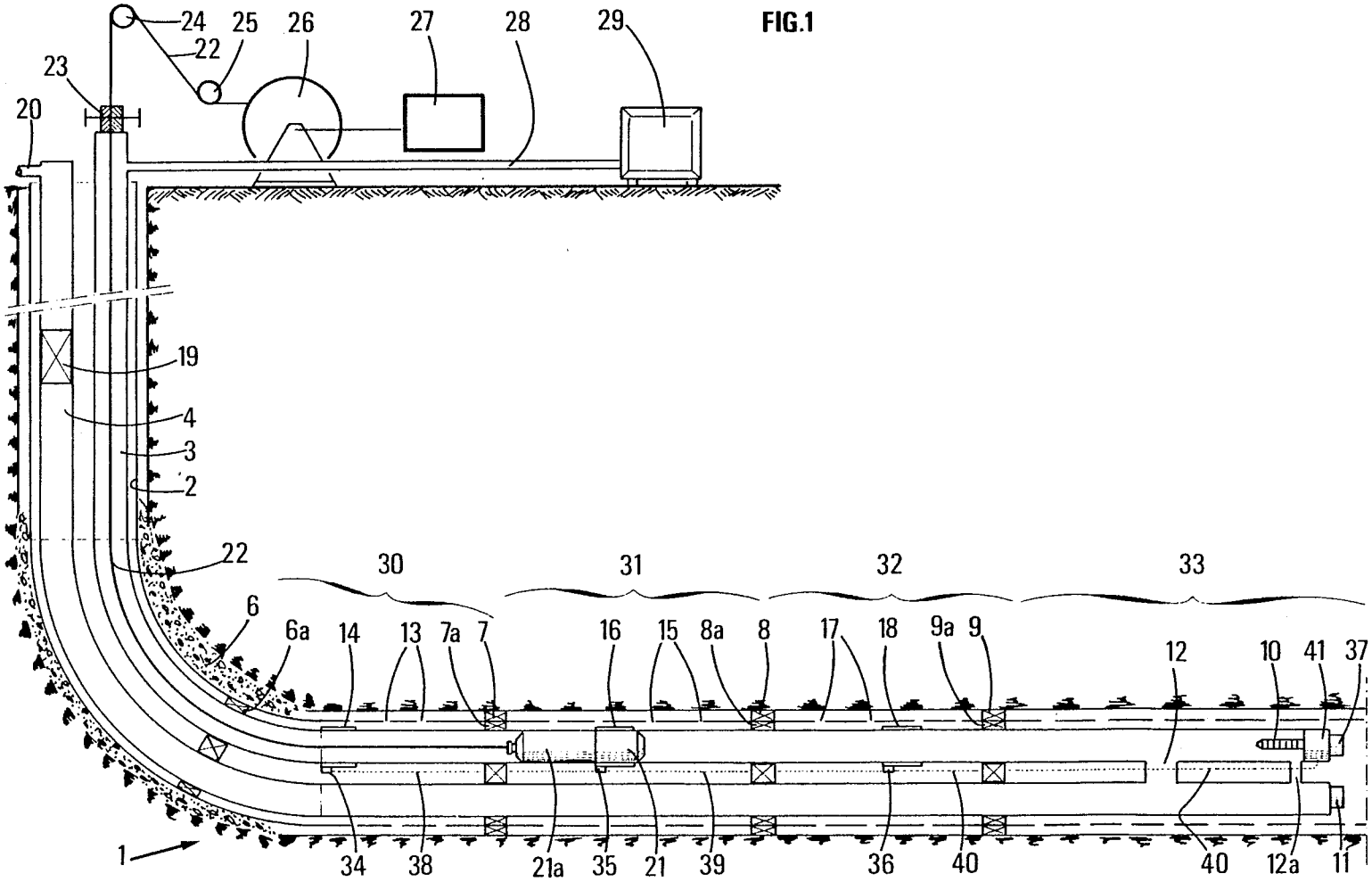
FIG. 1 is a cross section through a well equipped with the device according to the invention during the stage preceding connection.

FIG. 1, the well, having a part that is sharply tilted to the vertical or even horizontal, and equipped with a device according to the invention, is operated from the surface of the ground. This well 1 has, for a certain length, a casing string 2 inside which is a casing 3 and a pipe 4, which traverses the geological formations from which fluids are to be produced.

In order selectively to produce fluids from the geological formations according to said producing zones 30, 31, 32, 33, sealing means 7, 8, 9 of the packer type are disposed between casing string 2 and the formations and sealing means inside the casing string are disposed between casing string 2 and the first casing 3 and pipe 4. These internal means *6a, 7a, 8a, 9a* are located essentially at right angles to seals 7, 8, 9, respectively and are of the double packer type, for example.

Each of producing zones 30, 31, 32 communications with zones inside casing string 2 via orifices 13, 15, 17, respectively. Each zone can be made to communicate at will with the inside of first casing 3 by means of circulation valves such as sliding jacket valves 14, 16, 18, respectively.

During production, valves 14, 16, 18 are normally provided with check valves preventing fluid circulation from casing to the formations, but these check valves could be eliminated if, for example, a zone were to be fractured.

The lower end of pipe 4 has a remote-controllable valve 11 such as a sliding jacket valve similar to valves 14, 16, 18 and allowing lower part 33 of well 1 to be placed in communication with casing 3 and pipe 4, either for producing fluids from the well bottom (via pipe 4) or for the normal operating requirements of the well.

Pipe 4 connected to casing 3 by hydraulic connecting element 12 may, if needed, have, at the required depth, a circulating pump 19 which draws fluid from the formations and discharges it at the surface of the ground via outlet 20. Pump 19 may be a hydraulic, electric, or mechanical pump such as the plunger of a cup-packed beam pump. The position of pump 19 in the well may be substantially below the dynamic level of a producing formation. According to the invention, the circulation direction of the pump fluid may be upward and one-way.

The inside and lower end of casing 3 comprises a first connector 10 connected by electrical lines 40 to instruments or tools 34, 35, 36, 37 disposed in each of producing zones 30, 31, 32, 33.

This first connector 10 is designed to cooperate with a second connector 21 connected to the surface of the ground by a transmission cable 22.

This second connector 21 is introduced into casing 3 at its upper part, then moved to second connector 10 to cause them to cooperate.

Second connector 21 may include a loading bar 21*a* which allows this second connector 21 to be lowered by gravity, in particular for vertical wells or wells slightly inclined with respect to vertical. This element 21 may also have fittings designed to cooperate with the inside of casing 3, in particular for wells that are sharply inclined with respect to vertical or even horizontal or even rising, in ordet to provide a seal and thus move this connector 21 by hydraulic pumping produced either by station 29 which is connected to casing 3 by a pipe 28, or by the circulating pump 19 located in pipe 4.

The end of the casing has a passageway 12*a* located below hydraulic connection 12 which permits circulatgion of fluid, this hydraulic connection being designed to allow evacuation of mud or other sediment and also being designed to permit elimation of fluid present between first connector 10 and second connector 21, particularly when they are connected, by means of a suitable cross section. Hydraulic connection 12 is also designed to allow absorption of ther inertia of second connector 21 during its connection with first connector 10.

To cause second connector 21 to be lowered by hydraulic pumping of a fluid such as a degassed oil, the upper end of casing 3 has a stuffing box 23 through which transmission cable 22 passes before it is guided by two pulleys 24, 25, to winch 26 controlled by station 27.

When a well 1 such as a well drilled into geological formations containing hydrocarbons is placed in production, said well 1 is equipped with at least one casing 3 and a pipe 4 for safety reasons, in order to prevent circulation of fluid between casing string 2 and casing 3. Thus, when second connector 21 is moved, the fluid present thereunder rises in pipe 4. It will not be a departure from the scope of the invention, particularly when producing from a well, to connect hydraulic connection 12 to the annular space between casing 3 and casing string 2 by eliminating pipe 4.

Second connector 10 is connected to meansuring instruments 34, 35, 36, 37 located in producing zones 30, 31, 32, 33, respectively by means of electrical lines 38, 39, 40, 41. These instruments 34, 35, 36, 37 are designed to measure the flowrate of fluid passing through valves 14, 16, 18, 11, respectively, and the temperature and pressure of the fluids in each of producing zones 30, 31, 32, 33, respectively. In the same way as the pressure, flowrate, and temperature measurements, any other type of physical and/or chemical and/or physicochemical measurement such as the resistivity of fluids in the producing zones, may be measured. By providing an electrical link between the meansuring instruments and the surface, it is possible to obtain, at any moment, a real-time measurement of the characteristics of the fluids in each zone and thus establish an optimum production program by manipulating valves 14, 16, 18, 11 in each of the zones. For example, if the transmission cable has only one conductor, a multiplexer could be used to combine the information from the measuring instruments.

Valves 14, 16, 18 are selectively controlled from the surface of the ground either by wrench-type tools 21, 21*a*, or by hydraulic control. These tools are cable-controlled for vertical or slightly slanting wells, or with hydraulic engines for wells permitting hydraulic circulation according to the TLF (through flow line) technique or any other means such as that described in French Patent Application EN-87/11,749.

Figure 2:
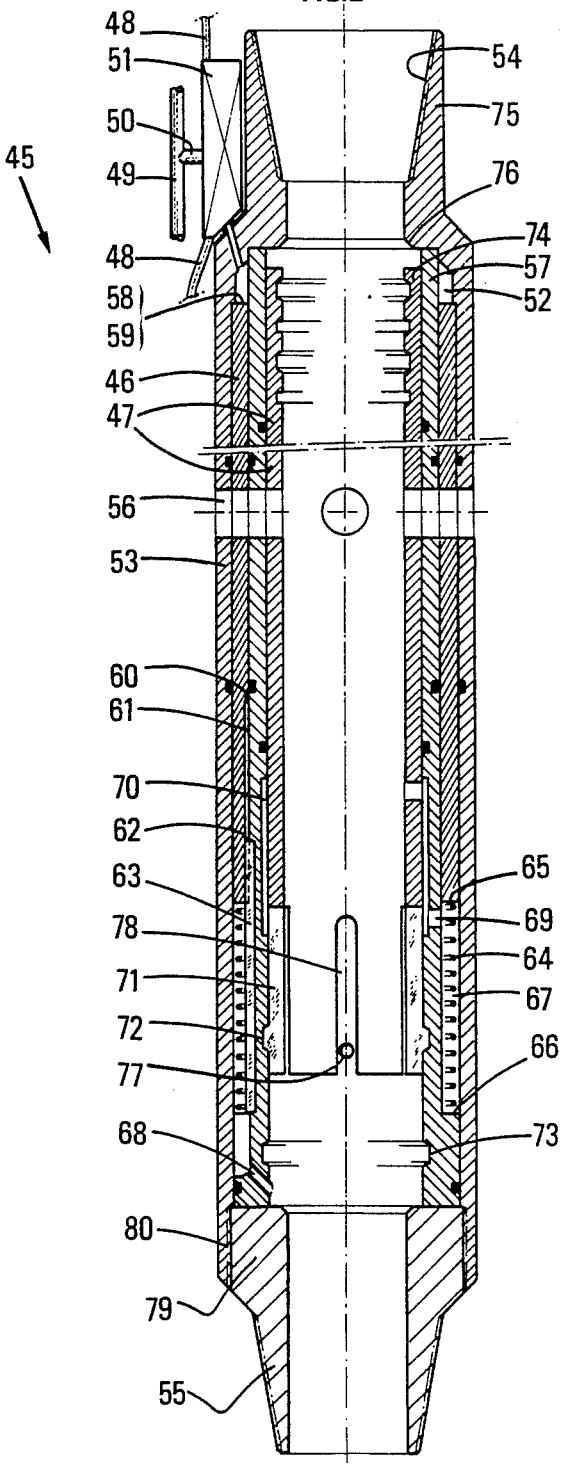
FIG. 2 shows in detail a selective hydrualic valve with a sliding jacket used in a device according to the invention.

FIG. 2 shows in detail a hydraulic valve 45 with a sliding jacket 46, 47 designed for selective production from a well according to the invention. This valve 45 places the outside into, and out of, communication with the inside of the casing.

A hydrualic line 49, providing the power source of the power elements such as elements similar to valve 45, communicates via a branch 50 with valve 45. On this branch 50 are disposed distribution means such as a solenoid valve 51, which are connected by an electrical cable 48 to socket 10 located at the lower end of casing 3 (FIG. 1).

This solenoid valve 45 provides, and interrupts, communication between hydraulic line 45 and hydraulic thrust chamber 52 of hydraulic sliding jacket 46.

Valve 45 has an outer cylindrical body 53 fitted into casing 3 by means of a conical female connector 54 at the top of the valve and a conical male connector 55 at the bottom.

In this body 53, providing the outer envelope of the valve, are disposed, essentially in the same plane perpendicular to the casing axis, four closable orifices 56 that alter communication between the inside and outside of the casing.

Orifices 56 are closed by sliding hydraulic jacket 46 or safety jacket 47.

An extension 57, separating jackets 46 and 47, together with hydraulic jacket 46 and body 53, defines hydraulic thrust chamber 52, and provides guidance of jackets 46 and 47.

A hydraulic jacket 46 slides between two extreme positions defined on the one hand by cooperation of an opening stop 58 with upper nipple 59 of hydraulic jacket 46, and on the other hand by cooperation of a bead 60 of a groove 61 made in the lower part of hydraulic jacket 46 with bead 62 of key 63. Key 63 is integral with extensxion 57 and, by cooperating with groove 61, rotationally positions hydraulic jacket 46 with respect to valve body 53.

A return spring 64, cooperating with lower nipple 65 of hydraulic jacket 46 and a shoulder 66 of extension 57, returns hydraulic jacket 46 to the resting position when the pressure inside thrust chamber 52 falls below a preset value.

The cylindrical space 67 defined by shoulder 66, lower nipple 65, body 53, and extension 57, in which spring 64 is located, terminates inside the casing by lower circulation orifice 68 and by upper circulation orifice 69, a recess 70, and holes made in safety jacket 47, in order to permit circulation of fluid and prevent spring 64 from jamming. Instead of causing this cylindrical space 67 to terminate inside the casing, this space 67 may be connected to a compensating chamber filled with a fluid that remains clean such as oil.

Safety jacket 47 slides inside cylindrical extension 57 between two positions defined by the cooperation of an elastic blade 71 having a projection with two inner annular grooves 72, 73 machined into extension 57 and allocating to jacket 47 an upper position and a lower position corresponding to the opening and closing, respectively, of orifices 56.

Safety jacket 47 is controlled by a socket 74 designed to cooperate with the bolt of a tool circulating in the casing. Upper part 75 of valve body 53 has, at the level of safety jacket 47, a chamfer 76 matching the clearance of the bolt. Jacket 47 is rotationally positioned with respect to body 53 by means of a projection 77 integral with extension 57 and cooperating with a groove 78 provided in jacket 47.

The lower end of valve 45 has a nipple 79 attached to body 53 by a thread 80, the nipple being provided with male conical connector 55.

In FIG. 2, valve 45 is shown as "normally open," i.e. when the pressure of the fluid acting on hydraulic jacket 46 is less than a given value, the orifices in the valve body are not blocked by jacket 46 because of the return force of spring 64 which causes opening stop 58 to cooperate with upper nipple 59 of hydraulic jacket 46.

It will not be a departure from the invention to use a "normally closed" valve. For this purpose, one need only for example elevate the orifices in hydraulic jacket 46 in such a way that, when opening stop 58 cooperates with upper nipple 59, orifices 56 are obstructed at the level of hydraulic jacket 46 and such that, when bead 60 of groove 61 cooperates with bead 62 of key 63, orifices 56 are clear at the level of hydraulic jacket 46.

Thrust chamber 52 corresponds to a reservoir designed to contain a variable mass of hydraulic fluid.

The orifices of valve 45 are closed by commanding, via electrical line 48, the opening of distribution means 51, by creating a suitable pressure in line 49 to create a fluid flow in a first direction and thus cause jacket 46 to descend.

To immobilize jacket 46 in the positions in which the orifices are open or closed, regardless of the pressure in line 49, distribution means 51 are closed.

The orifices of valve 45 are opened by opening distribution means 51 to place thrust chamber 52 in communication with the hydraulic line and creating a suitable pressure in line 49 in order to create a flow of fluid in a second direction opposite the first direction and thus elevate jacket 46, this pressure being less than the orifice closing pressure.

Figure 3:
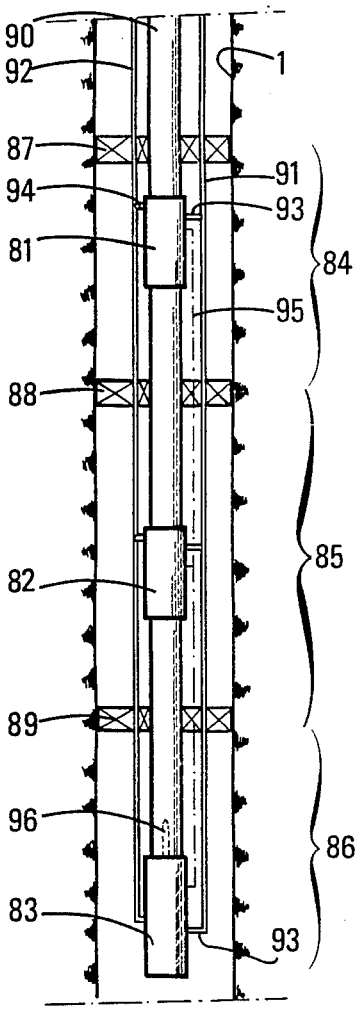
FIG. 3 shows schematically a device according to the invention having hydraulic tools or instruments.

FIG. 3 shows schematically a device having hydraulic tools or instruments 81, 82, 83 disposed on a casing 90 located in well 1, the device being designed in particular for selective production from different zones such as zones 30, 31, 32, 33 of FIG. 1 or 84, 85, 86 of FIG. 3. These tools or instruments may for example be the valves illustrated in FIG. 2. Zones 84, 85, 86 are respectively delimited by sealing elements 87–88, 88–89, 89 and the well bottom.

The device has a first line 91 and possibly a second hydraulic line 92, these lines being connected to the tools or instruments by branches 93, 94 respectively. Distribution means are disposed on branches 93 of first hydraulic line 91.

Distribution means of branches 93 are controlled by an electrical line 95 connected to a first electrical connector 96 disposed at the lower and inner part of the casing and designed to cooperate with a second matching electrical connector connected to the surface of the ground by a transmission cable 22 (FIG. 1). Just as the distribution means are controlled by an electrical line 95, these means may be controlled by hydraulic control lines connected, for example, to a hydraulically controlled connector.

First line 91 and possibly second hydraulic line 92 are connected to a hydraulic power generator disposed either at the surface of the ground or in the vicinity of the tools or instruments.

The transmission cable may have an electrical power line enabling a hydraulic power generator located in the vicinity of the tools or instruments to be supplied.

First line 91 and possibly second hydraulic line 92 may be connected to a hydraulic connector disposed inside the casing at its lower part, in the same way as electrical line 95 is connected to the electrical connector, whereby this hydraulic connector cooperates with a matching element connected to the surface of the ground by a hydraulic line.

These hydraulic and electrical connectors may be combined in one connector, and these hydraulic and electrical lines may be combined into the same line.

In order hydraulically and selectively to control, in two fluid circulation directions, at least two tools or instruments 81, 82, 83 with the aid of only one hydraulic line, the tools or instruments used are provided with return means allowing them to revert to an initial position when the pressure has dropped, and distribution means disposed in branches 93 of first hydraulic line 91 are used with said tools or instruments.

In order to activate a first tool or instrument, the distribution means of the second of the two tools or instruments or other tools or instruments are closed in order to reduce or even stop fluid circulation in the branch of the second tool or instrument. The distribution means of the first tool or instrument are opened in order to increase fluid circulation in the branch of the first tool or instrument, and a pressure is created in the first hydraulic line in order to create a flow of fluid in a first direction in the branch of the first tool or instrument.

When the flow of fluid is to be stopped, as may be necessary to close a valve, the distribution means of the first tool or instrument are closed.

To produce a flow in the branch of the first tool or instrument in a second direction, opposite the first direction, and in this way manipulate the first tool or instrument, the distribution means of the first tool or instrument are opened and the pressure in the first hydraulic line is released.

By selectively producing a flow in the branch of a tool or instrument, in either direction, it is thus possible to manipulate any type of tool or instrument, especially a valve, independently.

In the same way as the first tool or instrument has been manipulated, as many tools or instruments as desired may be manipulated.

In order to control hydraulically and selectively, in both fluid circulation directions, at least two tools or instruments 81, 82, 83 with the aid of two hydraulic lines only, a first hydraulic line 91 having branches 93 is used with the tools or instruments, circulation in the branches being controlled by distribution means located in each of these branches, and a second hydraulic line 92 having branches is used with the tools or instruments.

To activate a first tool or instrument, the distribution means of the second of said two tools or instruments are closed in order to reduce or even stop fluid circulation in the branches of the second tool or instrument. The distribution means of the first tool or instrument are opened to increase fluid circulation in the branch of the first tool or instrument, and pressures capable of producing fluid circulation in the branch with the first line, in a first or second direction, are created in the first or second line.

To allow circulation of fluid in the first or second circulation direction, as may be the case when opening or closing valve 45, a positive or negative pressure differential is created between the first and second lines.

In the same way as the first tool or instrument has been controlled independently of the second, any type of tool or instrument may be controlled independently of any other tool or instrument.

According to one particular embodiment of the device or implementation of the invention, pipe 4 may serve as a first or second hydraulic line. For this purpose, hydraulic connection 12 and passageway 12*a*, which provides the hydraulic connection between casing 3 and pipe 4, must be blocked by one or more blocking elements allowing the hydraulic power generator to create a pressure and a flow allowing the tool or instrument to be manipulated. This blocking element will advantageously be retractable in order to permit circulation of fluid when desired in casing 3 and pipe 4, for example to move any tool or instrument in the casing or pipe, such as second connector 21 or such as drilling or scraping tools.

We claim:

1. A device for hydraulically and selectively controlling a set of at least two instruments or tools connected to a casing located inside a well having at least two different producing zones, said two instruments or tools being disposed adjacent to each of said producing zones, characterized by having a first hydraulic line with branches to said instruments or tools and by having distribution means including solenoid valve means placed on each of the branches and controlled independently of each other by a control element, said first hydraulic line being connected to a hydraulic power generator.

2. A device according to claim 1, characterized in that the control element includes an electrical line.

3. A device according to claim 2, characterized in that said electrical line is connected to a first electrical connector located inside said casing and cooperates with a second matching electrical connector connected to the surface of the ground by a transmission cable.

4. A device according to one of claims 1, 2 or 3, characterized in that said two zones are separated from each other in the well by a sealing means including an annular seal.

5. A device according to one of claims 1, 2 or 3, characterized in that said first hydraulic line is connected to the surface of the ground by the outside of said casing.

6. A device according to one of claims 1, 2 or 3, characterized in that said first hydraulic line is connected to a first hydraulic connector located inside said casing and cooperates with a second matching hydraulic element connected to the surface of the ground by a pipe.

7. A device according to one of claims 1, 2 or 3, characterized in that a second hydraulic line is provided including at least one branch supplying one of said instruments or tools.

8. A device according to one of claims 1, 2 or 3, characterized in that at least one of said tools or instruments includes a reservoir designed to contain a variable quantity of hydraulic fluid, and in that the reservoir is connected by a branch to the first hydraulic line.

9. A device according to one of claims 1, 2 or 3, characterized in that said first hydraulic line is connected to said casing by a hydraulic connection including at least one shut off element.

10. Process for hydraulically and selectively controlling, in two circulation directions, at least two tools or instruments of a device connected to a casing located inside a well, said device including a first hydraulic line with branches to a first and a second of said at least two tools or instruments, distribution means for modifying the circulation of fluid in each of the branches and controlled independently of each other, and a hydraulic power generator connected to said first hydraulic line, characterized in that, to selectively activate said first tool or instrument, the process comprises the steps of:

shutting off the distribution means of said second tool or instrument to reduce fluid circulation in the branch of the second tool or instrument, opening the distribution means of the first tool or instrument to increase fluid circulation in the branch of the first tool or instrument, and applying pressure in the first hydraulic line to create a flow of fluid in the first direction in the branch of the first tool or instrument.

11. Process according to claim 10, characterized in that the first tool or instrument permits circulation of hydraulic fluid in the two opposite directions and includes a reservoir for containing a variable mass of fluid, the process further comprising the steps of connecting said reservoir by the first of said branches to said first hydraulic line, and producing a flow in the branch of the first tool or instrument in a second direction opposite to the first direction by opening the distribution means of the first tool or instrument and reducing the pressure in the first hydraulic line.

12. Process according to one of claims 10 or 11, characterized in that a second hydraulic line is provided including at least one branch to at least one of said tools or instruments, the process further comprising the steps of producing fluid circulation in said branch with the first hydraulic line of the tool or instrument connected to the second hydraulic line in a first direction or in a second direction opposite the first direction, opening the distribution means of the tool or instrument connected to the two lines, and creating pressures in at least one of the first and second line, pressures are to produce fluid circulation in the branch to the first line in at least one of the first and second directions.

13. Process according to claim 12, characterized in that the second tool or instrument permits hydraulic fluid circulation in the two opposite directions and includes a reservoir for containing a variable mass of fluid and connected by the second of the branches to said hydraulic line, return means allow the second tool or instrument to revert to an initial position, and in that, to selectively activate the second tool or instrument, the process further comprises the steps of:

closing the distribution means of the first tool or instrument to prevent circulation of fluid in the branch of the first tool or instrument, opening the distribution means of the second tool or instrument to permit fluid circulation in the branch of the second tool or instrument, pressurizing said first hydraulic line to create a flow of fluid in said first direction in the branch of the second tool or instrument, and reducing the pressure in said first hydraulic line to produce a flow in said second direction opposite the first direction in the branch of the second tool or instrument.

14. Process according to claim 13, characterized in that the process further comprises shutting off the distribution means of at least one of the first and second tool or instrument to prevent fluid circulation in the branch of one of the first and second tool or instrument once fluid circulation has been produced in the first or second tool or instrument in at least one of the first and second directions.

15. Process according to claim 14, applied to selective production of a deposit, characterized by locating the first and second tool or instrument on the casing, and modifying a rate of production fluid transfer between an inside and an outside of the casing by the first and second tool or instrument.

16. Process according to claim 15, characterized by electrically controlling the distribution means by a cable connected to a first electrical connector located inside the casing, introducing and moving a second matching electrical connector being introduced in the casing, connecting the connector to the surface of the ground by a transmission cable, and causing the first and second electrical connectors to cooperate to control the distribution means from the surface of the ground.

17. Process according to claim 16, characterized by disposing the hydraulic power generator in the well in a vicinity of said tools or instruments.

18. Process according to claim 16, characterized by connecting said hydraulic line to a first hydraulic connector located inside the casing, introducing and moving in the casing a second matching hydraulic connector connected to the surface of the ground by a pipe, causing the first and second hydraulic connectors to cooperate, and locating the hydraulic power generator at an end of the pipe near the surface of the ground.

19. Process according to claim 12, characterized by locating a pipe connected to said casing in the well by a hydraulic connection, disposing on said hydraulic connection and element designed to shut off said hydraulic connecting, connecting said pipe to said hydraulic power generator, and using said pipe as said first or second hydraulic line.

20. A valve for production from wells drilled into the ground, the valve comprising an external cylindrical body adapted to fit into a casing, a plurality of orifice means provided in said external cylindrical body for communicating an inside of the casing with an outside thereof, an extension means disposed inside said external cylindrical body, a jacket means sliding between said external cylindrical body and said extension means for allowing changes in a size of said orifice means, a thrust chamber means delimited by said external cylindrical body, said extension means, and one end of said jacket means, said thrust chamber means being connected to hydraulic control means including a line means connected to a hydraulic generator, and return means including a spring means acting on said jacket means, and wherein said hydraulic control means tends to move said jacket means in a direction away from an initial position against an action of said return means so as to change the sizes of said orifice means, said return means being adapted to return said jacket means to said initial position in an absence of sufficient action on the part of said hydraulic control means.

21. Valve according to claim 20, further comprising a safety jacket means separated from said jacket means by said extension means and controlled mechanically by an inside of the casing for changing the sizes of the orifice means.

22. Valve according to one of claims 20 or 21, used in a process for hydraulically and selectively controlling, in two circulation directions, at least two tools or instruments connected to the casing.

* * * * *